US005711475A

United States Patent [19]

Tedford, Jr.

[11] Patent Number: 5,711,475

[45] Date of Patent: Jan. 27, 1998

[54] CONTAINER FIXANT APPLICATOR AND METHOD FOR PRODUCTION AND APPLICATION THEREFOR

[75] Inventor: Richard A. Tedford, Jr., Wallkill, N.Y.

[73] Assignee: International Paper Company, Tuxedo Park, N.Y.

[21] Appl. No.: 591,815

[22] Filed: Jan. 25, 1996

[51] Int. Cl.[6] ..... B65D 5/40; B65D 5/56

[52] U.S. Cl. ..... 229/3.1; 229/125.42; 229/198.3; 277/9; 277/12

[58] Field of Search ..... 229/3.1, 137, 125, 229/42, 198.3; 277/6, 9, 12, 189, 227

[56] References Cited

U.S. PATENT DOCUMENTS 3,474,951 10/1969 Egleston et al. .

3,913,825 10/1975 Brownlee et al. .

3,998,378 12/1976 Vetten .

4,801,073 1/1989 Farber .

*Primary Examiner*—Gary E. Elkins

*Attorney, Agent, or Firm*—Stewart L. Gitler; Martin P. Hoffman; Michael J. Doyle

[57] ABSTRACT

A container fixant applicator configured to complement target fixing zones of a container. Caulk is introduced into a container, over portions of the container intended to be fixed. The caulk is activated, flowing between the target surfaces. The caulk cures, fixing the container. The wafer substantially retains its configuration during the fixing of the container. The wafer is configured so that it may not pass through the pour spout of a gable top-type container. Methods for producing and applying the container fixant applicator are also provided.

6 Claims, 4 Drawing Sheets

CONTAINER FIXANT APPLICATOR AND METHOD FOR PRODUCTION AND APPLICATION THEREFOR

BACKGROUND OF THE INVENTION

1. Field of the Invention

The present invention relates to comestible and beverage containers. More specifically, the present invention relates to products and methods for sealing containers for consumables.

2. Description of the Prior Art

Consumable containers are evolving rapidly to satisfy the many divergent functional and commercial considerations that drive the food and drink industry. Containers assume an inexhaustible number of configurations, constructed from a wide variety of materials, such as pulp wood sheet stock and glue. Typically, the stock material is configured into an appropriate container shape. A bonding and/or sealing agent, "fixant" hereinafter, is applied to the edges of the flaps or gusset tips of the container. Theoretically, the fixant cures, maintaining the shape of the container. However, fixing the container is problematic in many respects.

First, containers often leak. The fixant is not always introduced into the areas requiring fixant. Sometimes bubbles form in the fixant that rupture, disintegrating the adhesion or seal. These fixing problems are largely attributable to the application means. Many container manufacturers employ applicators or glue guns to apply fixant to seal the containers. Conventional applicators can not be manipulated into every area and inject fixant where needed. Also, the fixant sprayed by the applicator exhibits anisotropic curing characteristics throughout the mass of the fixant: portions of the fixant have cured relative to other portions. A portion of the fixant adheres to the walls of the conduit conveying it from the reservoir to the tip of the applicator. Eventually, the Venturi effect created by the fixant flowing through the conduit draws some of this older fixant back into the stream and out through the tip onto the target fixing zone. This partially cured fixant does not seal the container gussets as effectively as fresher fixant which cures in toto at the gussets. A need exists for a fixant applicator and application method therefor that improves application accuracy, reduces bubble formation therein and eliminates introduction of partially cured fixant to the fixing zone.

Second, containers sometimes present potential health and safety risks to consumers. Occasionally foreign matter may mix with and contaminate the consumable. Again, the fixant application means are significantly responsible. To avert leakage problems, container manufacturers introduce excess fixant into the container. A portion of this excess fixant forms into pellets or strings that break off. These fragments may be ingested by a consumer with unfortunate consequences. A need exists for a fixant applicator and application method therefor that reduces the potential for fragment formation within a container.

Third, container manufacturing is inefficient and wasteful. As mentioned above, container manufactures introduce excess fixant into the container to insure it is sealed. Fixant is expensive. Deploying excess fixant is a cost that could be avoided. Also, cycle time for manufacturing the containers is increased when an excess amount of fixant is applied to the container. This cycle time is further increased by the additional cure time that attends the deposition of a large volume of curable material. A need exists for a fixant applicator and application method therefor that reduces the amount of fixant required to seal the container and reduces the amount of time required to apply liquid to and cure fixant on the fixing zone.

The patent literature is replete with many inventions that address some of the issues discussed above. However, none include a caulk or sealant, configured to complement target fixing zones, that may be carried on a wafer, configured such that the fixant applicator may not be voided from a container. For example, U.S. Pat. No. 3,474,951, issued Oct. 28, 1969, to H. B. Egleston et al., and U.S. Pat. No. 3,998,378, issued Dec. 21, 1976, to W. Vetten, describe container closures involving local heat sealing of container panels. Following Egleston et al., once the container is formed, the overlying panels are heat-pressure sealed with a heating element or die having a design generally corresponding to the outline shape of the target fixing zone. The heating element causes the local flow of the thermoplastic coating on the sheet material that defines the container. According to Vetten, heat is applied to a broader area of the container, then the target zones are locally compressed.

U.S. Pat. No. 4,801,073, issued Jan. 31, 1989, to J. F ärber, describes a folding box having a rectangular liquid-tight cemented bottom. The panels defining the box have notches that provide access to the inner panels such that they may be "filmed over with the coating material 6, preferably plastic." Column 2, lines 17–18. The patent describes a "pile up of coating material," at column 1, line 64, however, this refers to the layer "filmed over" the extant layers of coating on both sides of the sheet material defining the container.

U.S. Pat. No. 3,913,825, issued Oct. 21, 1975, to M. A. Brownlee et al., describes a leak proof bottom for a paperboard container. During the blanking of the thermoplastic container stock, a narrow band of thermoplastic material is deposited on the interior side of one of the bottom-forming flaps. The blank is formed to define the container; the flaps are brought into contact and heat sealed.

Clearly the above demonstrates a need for a container fixant applicator and method for producing and application therefor that includes a caulk or sealant, configured to complement target fixing zones, that may be carried on a wafer, configured such that the fixant may not be voided from a container.

None of the above are regarded as describing or teaching the present applicators, production, or application method.

SUMMARY OF THE INVENTION

The present invention overcomes the limitations of the above by providing a container fixant applicator and production and application methods therefor that: improve application accuracy; reduce bubble formation therein; eliminate introduction of partially cured fixant into a container; reduce the potential for fragment formation within the container; reduce the amount of fixant required to fix the container; and reduce the amount of time required to apply and cure the fixant in the container.

A first embodiment of the inventive fixant applicator includes a non-activatable wafer with a reservoir into which the caulk is injected. The wafer substantially retains its configuration during the fixing of the container. The wafer is configured so that it may not pass through the opening of the container, specifically, the pour spout formed in a gable top-type container. The convenient caulk-carrying wafer may be transported and introduced into a container easily and neatly. When the caulk is activated, it flows out of the wafer over the target zones of the container. The caulk is cured, fixing the container.

The inventive method for producing the preferred embodiment of the present fixant applicator includes providing a wafer having a reservoir and introducing the caulk therein.

An alternate embodiment of the inventive fixant applicator includes an activatable caulk configured to complement a target fixing zone. The fixant applicator is manipulated and introduced into a container, over the target zone. The caulk is activated and flows between the target zone surfaces. The caulk cures, fixing the container.

The inventive method for producing the alternate embodiment of the present fixant applicator includes co-extruding the caulk into a configuration that complements a target fixing zone. This first method may include disposing voids within the caulk at predetermined points within the caulk.

A third alternate embodiment of the inventive fixant applicator includes bonding a layer of caulk onto the wafer. This convenient caulk-carrying wafer also may be transported and introduced into a container easily and neatly. When the caulk is activated, it flows over the target zones of the container. The caulk cures, fixing the container.

The inventive method for producing the third alternate embodiment of the present fixant applicator includes providing a wafer and bonding caulk to the wafer such that the wafer and caulk assume a laminar configuration.

Finally, the inventive method for applying fixant to a container includes introducing the present fixant applicator into a container proximate to a target fixing zone and activating the caulk, fixing the container.

In consideration of the above, an object of the invention is to provide a fixant applicator and methods for producing and applying it, that assures the bonding of a container.

A second object of the invention is to provide a container fixant applicator and methods for producing and applying it, that assures the sealing of a container.

A third object of the invention is to provide a container fixant applicator and methods for producing and applying it, the fixant applicator being readily transportable and introducible into a pre-configured, unfixed container.

A fourth object of the invention is to provide a container fixant applicator and methods for producing and applying it, the fixant applicator being configured to complement a target fixing zone of a container.

A fifth object of the invention is to provide a container fixant applicator and methods for producing and applying it, the fixant applicator being configured such that it is not voidable from a container.

A sixth object of the invention is to provide a container fixant applicator and methods for producing and applying it, that eliminates the potential for pellets or strings of fixing agent from forming within a container during its construction.

A seventh object of the invention is to provide a container fixant applicator and methods for producing and applying it, that eliminates the potential for deploying excess fixing agent during formation of a container.

An eighth object of the invention is to provide a container fixant applicator and methods for producing and applying it, that improves application accuracy thereof.

A ninth object of the invention is to provide a container fixant applicator and methods for producing and applying it, that reduces bubble formation in the fixant.

An tenth object of the invention is to provide a container fixant applicator and methods for producing and applying it, that eliminates introduction of partially cured fixant into a container.

An eleventh object of the invention is to provide a container fixant applicator and methods for producing and applying it, that reduce the amount of time required to apply and cure the fixant applicator in the container.

A twelfth object of the invention is to provide a container fixant applicator and methods therefor including an activatable caulk.

A thirteenth object of the invention is to provide a container fixant compound and methods for producing and applying it including a non-activatable wafer that carries activatable caulk.

A fourteenth object of the invention is to provide improved elements and arrangements thereof in an apparatus for the purposes described which is inexpensive, dependable and fully effective in accomplishing its intended purposes.

These and other objects of the present invention will become readily apparent upon further review of the following specification and drawings.

DETAILED DESCRIPTION OF THE INVENTION

Figure 1:
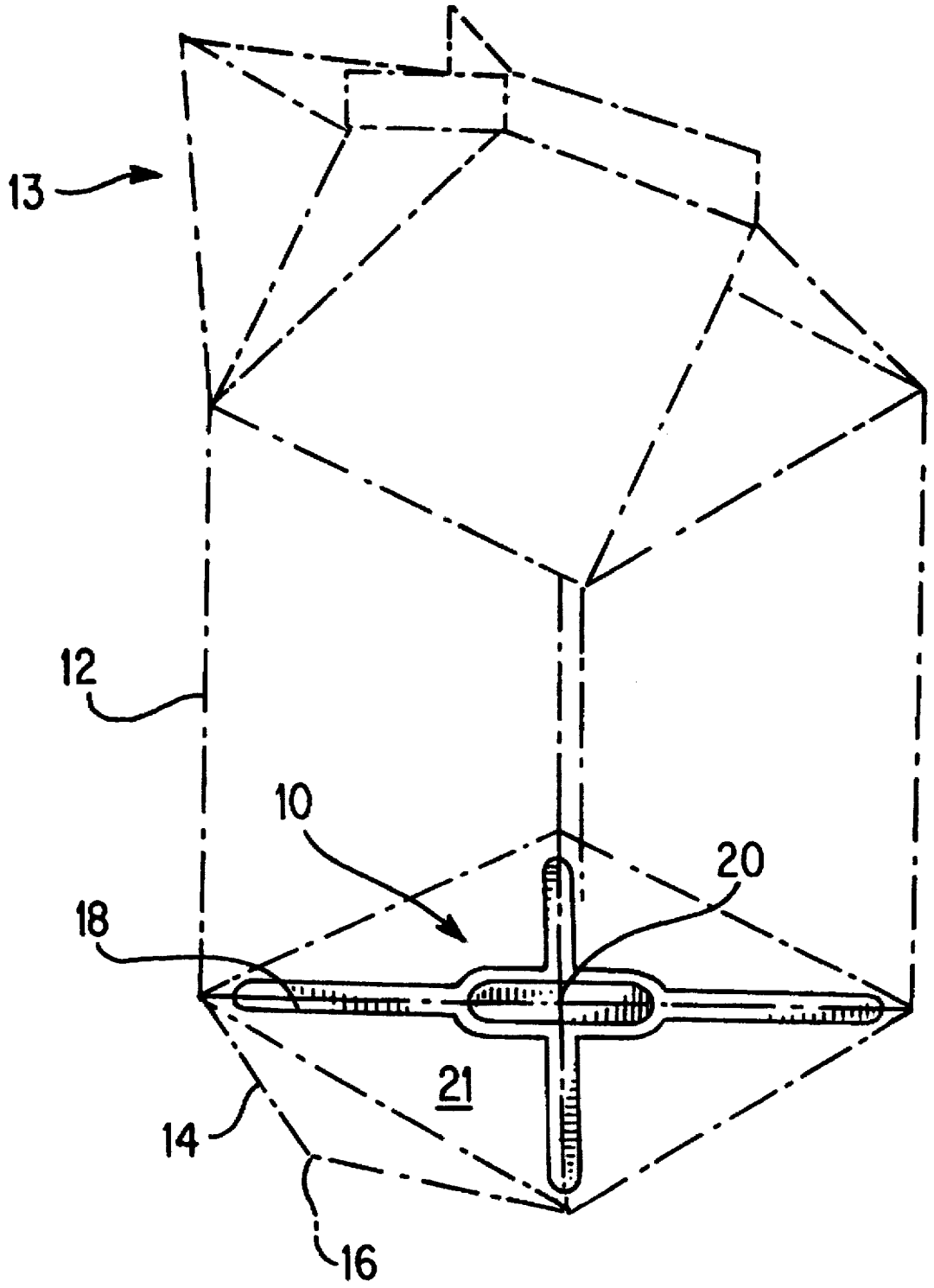
FIG. 1 is a top, front environmental perspective view of the present fixant applicator disposed on the floor of a container, the container being shown in dashed lines.

Referring to FIG. 1, the present fixant applicator, represented generally with the numeral 10, is shown disposed on the floor of a conventional gable-top type container 12 having a pour spout 13. The container 12 includes gussets 14 having tips 16 that are folded into contact. The gussets 14 are shown being fixed along the four contact edges 18 between the gussets 14 and the point 20 at which the tips 16 contact. In this particular application, "fixing" includes bonding to maintain structural integrity and sealing to prevent leakage.

The invention may be configured to adapt to virtually any two- or three-dimensional target fixing zone. In FIG. 1, the fixant applicator 10 is shown adapted for a two-dimensional fixing zone, a zone substantially existing only in the X–Y plane 21. Were the container 12 to include a punt (not shown), the fixing zone would have a three-dimensional frustoconical or frustopyrimidal shape. In that case, the fixant applicator 10 would be configured to complementarily mate with the three-dimensional target fixing zone (not shown) thereon.

The fixant applicator 10 must retain properties rendering it readily maneuverable without experiencing significant deformation. The fixant applicator 10 is intended to be manipulated, either manually or mechanically, and introduced into a container. The fixant applicator 10, having been configured to complement the target surfaces, also should retain sufficient stability such that delivery of fixant applicator to the target surfaces is assured.

A significant benefit afforded by the present fixant applicator is assured delivery of an appropriate amount of fixant applicator to the target zone. This reduces the time spent applying and curing fixant applied to the container.

Another benefit is elimination of string and pellet formation during introduction of fixant into the container. Strings and pellets easily form between a conventional fixant application and the target zone. These formations break off and pose health threats to potential consumers of the containers contents. The present fixant, upon activation, flows and spreads; it is not able to form into strings or pellets.

Figure 2:
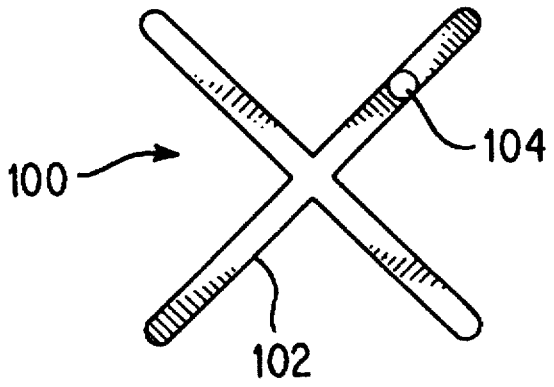
FIG. 2 is a top plan view of the first embodiment of the present fixant applicator.

Referring to FIG. 2, a first embodiment 100 of the inventive fixant applicator includes an activatable caulk 102. The caulk 102 is configured to assume a shape that complements the shape of a target zone, a cross shape in this case. When activated, the caulk 102 flows between the target zone surfaces. After activation, the caulk 102 cures, fixing the container.

The caulk 102, preferably, is a thermoplastic material, such as a hot melt adhesive, low density polyethylene (LDPE), ethylene vinyl acetate, ethylene vinyl alcohol (EVOH), or other equivalent food grade compositions. The material becomes malleable when heated, then cures when cooled. The caulk 102 also may be a thermosetting plastic. When heated to a predetermined temperature, the caulk 102 sets, fixing the target zones. These examples are only suggestions; the caulk 102 may be constructed from any materials that do not frustrate the purposes of the invention.

The first embodiment 100 of the present fixant applicator 10 may be formed with non-uniform segments (not shown). This non-uniformity permits manufacturers to supply a greater amount of fixant only to the zones requiring more than others. A manufacturer need not apply excess fixant to all of the fixing zones in order to assure fixing one troublesome area.

The first embodiment 100 of the inventive fixant applicator may have voids 104 disposed at predetermined locations therein. The voids 104 serve to reduce the concentration of caulk 102 delivered to specific points (not shown) of a target zone. This is useful especially in applications where the target zone has a complicated configuration and/or has breaks therealong. The fixant applicator 10 is intended to be manufactured in a single piece that may readily be placed in association with the target zones.

Figure 7:
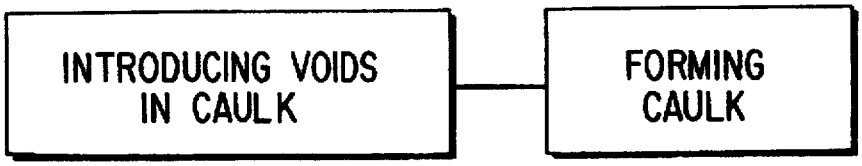
FIG. 7 is a flow diagram of the present method for producing the first embodiment of the present fixant applicator.

Referring to FIG. 7, the inventive method for producing a first embodiment 100 of the present fixant applicator 10 includes the steps of providing and forming caulk into a predetermined configuration. The caulk is constructed from materials as described above. Although extrusion is the preferred means for forming the caulk, stamping or other equivalent forming methods are well within the scope of the present invention. Extrusion provides the simplest and most cost effective means for producing the present fixant applicator.

Figure 3:
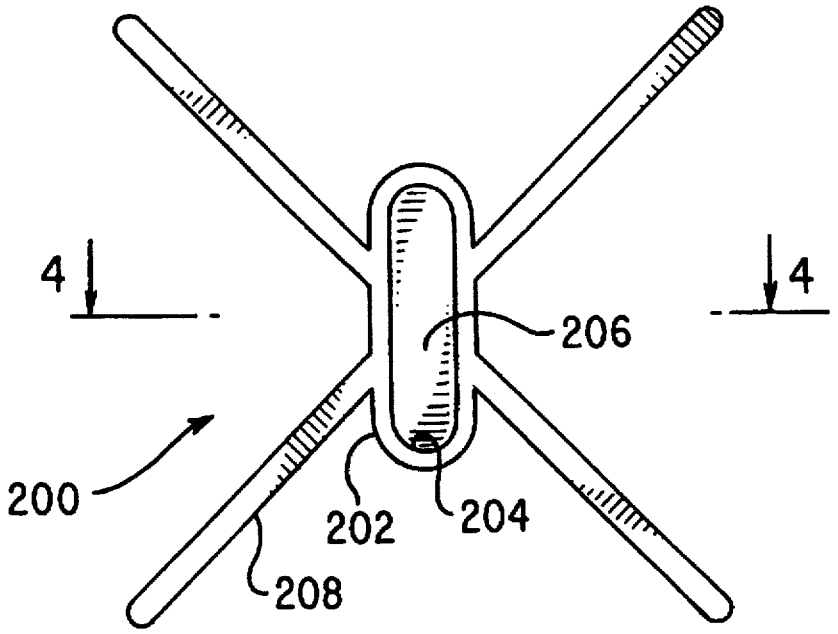
FIG. 3 is a top plan view of the second embodiment of the present fixant applicator.
Figure 4:
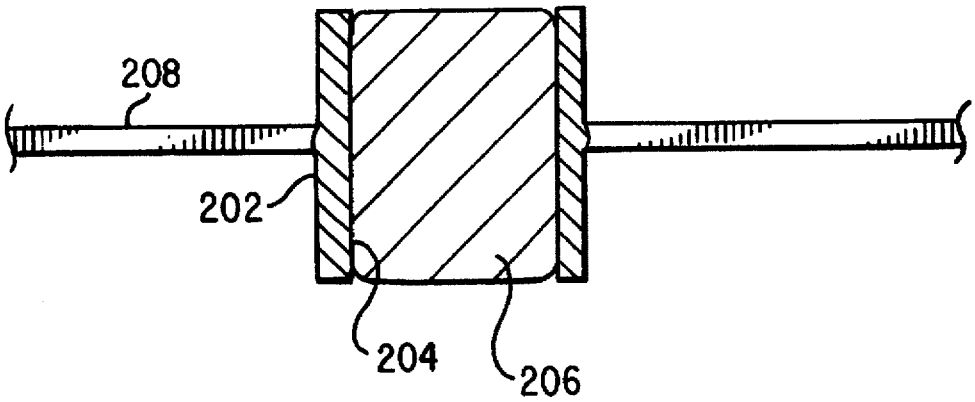
FIG. 4 is a cross-sectional detail view of the second embodiment of the present fixant applicator drawn along lines 4—4 in FIG. 3.

Referring to FIGS. 3 and 4, a second embodiment 200 of the inventive fixant applicator 10 is shown. The second embodiment 200 includes a wafer 202 having a reservoir 204 therein. The reservoir 204 receives caulk 206 exhibiting properties as described for the caulk 102, discussed supra. The wafer 202, on the other hand, is constructed from material that sustains its configuration during fixing of the container. The wafer 202 need not substantially retain its shape, only so much as necessary to achieve the purposes of the invention. The wafer 202 may be constructed from such materials as high density polyethylene (HDPE), polyethylene terephthalates (PET), nylon caulk material, or other equivalent food grade compositions.

As depicted in the first embodiment of the wafer illustrated in FIG. 2, voids may also be located in the second embodiment of the wafer at predetermined locations therein.

The wafer 202 is shown including a plurality of legs 208. The legs 208 discourage voidance of the fixant applicator 200 from a container in the unfortunate case in which the container was not properly fixed, the fixant applicator 10 remaining loose within the container. Referring again to FIG. 1, the legs 208 of the wafer 202 are configured to be long enough to wedge against the pour spout 13 of a conventional, gable-top type container 12. In FIG. 3, four legs 208 are shown. However, three legs 208 would suffice to discourage voidance of the second embodiment 200 of the fixant applicator 10 from the container 12. (TWO legs 208 engenders a risk that the wafer 202 could assume an orientation relative to the fluid flow through the pour spout 13 such that the fixant applicator 10 could be voided.) This voidance-prohibiting feature forestalls potential choking or other dangers that may attend ingestion of the fixant applicator 10.

The legs 208 may be configured (not shown) to provide for conveniently carrying the caulk 206 proximate to predetermined target zones. When the caulk 206 is activated, it flows out of the reservoir 204 and/or legs 208 of the wafer 202 and over the target zones of the container. The caulk 206 cures and fixes the container.

Figure 8:
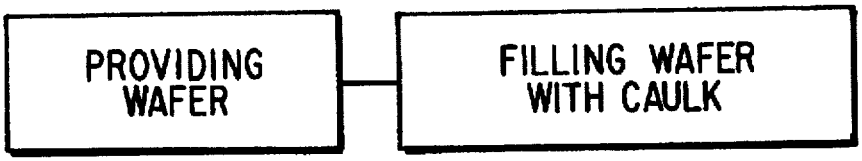
FIG. 8 is a flow diagram of the present method for producing the second embodiment of present fixant applicator.

Referring to FIG. 8, the inventive method for producing the second embodiment 200 of the present fixant applicator includes providing a wafer and introducing caulk wherein. The wafer and caulk are constructed from materials similar to those described above. The wafer retains its general configuration during fixing of a container.

Figure 6:
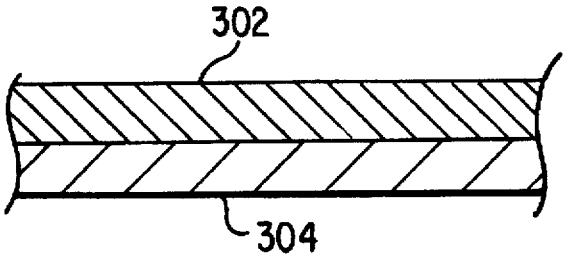
FIG. 6 is a cross-sectional detail view of the third embodiment of the present fixant applicator drawn along lines 6—6 in FIG. 5.
Figure 5:
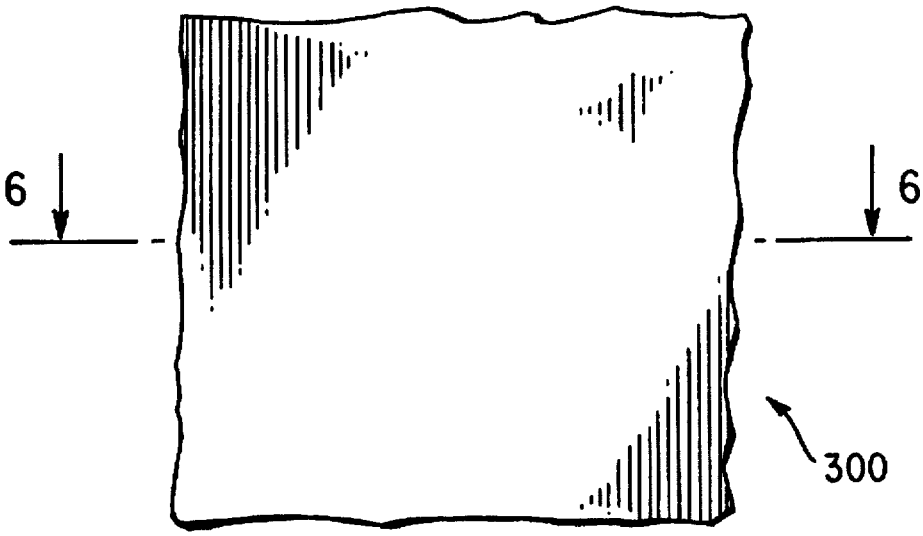
FIG. 5 is a top, front environmental perspective view of the third embodiment of the present fixant applicator.

Referring to FIGS. 5 and 6, a third embodiment 300 of the present fixant applicator 10 is shown. The third embodiment 300 includes a wafer 302 having a planar shape. The wafer 302 is constructed from materials exhibiting similar characteristics as those for the wafer 202, described supra. A layer of caulk 304 is bonded onto the wafer 302. The caulk 304 is constructed from materials exhibiting similar properties as the caulk 104 and 206, described supra. The caulk 304 may be bonded on the wafer 302 in a pattern that complements the shape of a target zone. Referring again to FIG. 1, the target zone is cross-shaped. The caulk 304 would be applied to the wafer 302 in laminate strips only in areas that would be proximate to the target zone once the fixant applicator 10 is properly situated in the container. Alternatively, the caulk 304 may be applied to the entire wafer 302.

As with the wafer 202 of the second embodiment 200 of the present fixant applicator 10, the wafer 302 retains its configuration during fixing of the container only so much as necessary to achieve the purposes of the invention. The wafer 302 is configured such that it is discouraged from passing out of the container, specifically, the pour spout 13 of a conventional gable-top type container 12, as best seen in FIG. 1.

Figure 9:
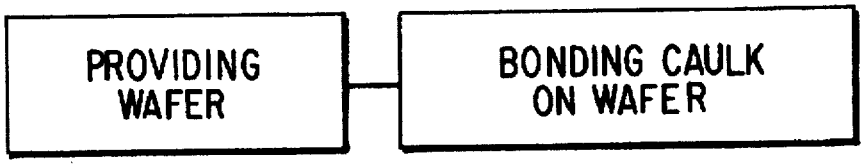
FIG. 9 is a flow diagram of the present method for producing the third embodiment of present fixant applicator.

Referring to FIG. 9, the inventive method for producing the third embodiment 300 of the present fixant applicator 10 includes providing a wafer and bonding caulk to the wafer. The wafer and caulk are constructed from materials similar to those described above.

Figure 10:
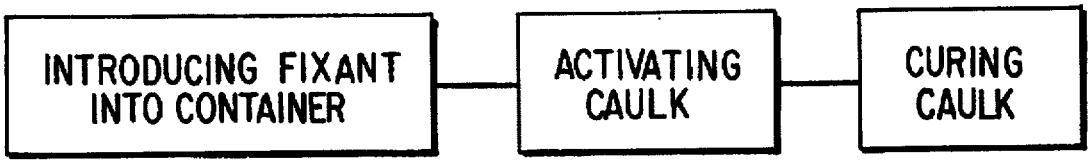
FIG. 10 is a flow diagram of the present method for applying any of the present fixant applicators to a container.

Referring to FIG. 10, the inventive method for fixing a container includes introducing any of the present fixant applicators 10 into a container, activating the caulk and curing the caulk.

Referring again to FIG. 1, the caulk should be located proximate to the target fixing zones. The caulk itself may be configured to complement a target fixing zone or carried by a wafer. If the caulk is carried by a wafer, the wafer should be configured such that it may not be voided from a container. Specifically, the wafer should not be able to pass out of the pour spout 13 of a convention gable-top type container 12, as best seen in FIG. 1. The wafer also should not be activatable to the extent that it deforms sufficiently to permit its voidance from the container 12.

Once the preferred fixant applicator 10 is properly introduced, the method includes activating the caulk. The caulk seeps into contact with the target fixing zones. In addition to fluid flow, the caulk may be assisted by capillary action or wicking in order to fulfill the purposes of the invention.

After the caulk is activated and associated with the target fixing zones, the method includes curing the caulk. Curing may be accomplished by any conventional means, such as cooling or administering curative agents which transform the caulk from a non-adhering to an adhering state. Once cured, the caulk should retain sufficient strength to maintain sufficient structural integrity of the container to fulfill the intended purposes of the container.

The present invention is not intended to be limited to the embodiments described above, but to encompass any and all embodiments within the scope of the following claims.

I claim:

1. A container fixant applicator comprising a wafer having a reservoir, said reservoir having a caulk retained therein, wherein said wafer being configured to compliment a target fixing zone and having at least three legs which discourage voidance of said fixant applicator from a container.

2. A container fixant applicator as claimed in claim 1, wherein said wafer voids are disposed at predetermined locations therein.

3. A container fixant applicator as recited in claim 1, wherein said caulk is constructed from a material selected from the group consisting of: ethylene vinyl acetate, low density polyethylene, ethyl vinyl alcohol or combinations thereof.

4. A container fixant applicator as recited in claim 1, wherein said wafer is constructed from a material selected from the group consisting of: high density polyethylene, nylon, polyethylene terephthalates or combinations thereof.

5. A container fixant applicator as recited in claim 1, wherein said wafer has four legs and a central reservoir for said caulk.

6. A container fixant applicator as recited in claim 1, wherein said wafer is comprised of a caulk material.

* * * * *